US006589314B1

(12) United States Patent
Page et al.

(10) Patent No.: US 6,589,314 B1
(45) Date of Patent: Jul. 8, 2003

(54) METHOD AND APPARATUS FOR AGGLOMERATION

(75) Inventors: Andrew E. Page, Kansas City, MO (US); Plamen Doynov, Kansas City, MO (US)

(73) Assignee: Midwest Research Institute, Kansas City, MO (US)

( * ) Notice: Subject to any disclaimer, the term of this patent is extended or adjusted under 35 U.S.C. 154(b) by 0 days.

(21) Appl. No.: 10/011,130

(22) Filed: Dec. 6, 2001

(51) Int. Cl.[7] ..... B03C 3/011

(52) U.S. Cl. ..... 95/32; 55/462; 95/69; 95/78; 96/56; 96/57; 96/77; 209/127.4

(58) Field of Search ..... 96/56, 57, 77, 96/61; 95/32, 62, 63, 69, 29, 78; 209/127.1, 127.4; 55/462, 464

(56) References Cited

U.S. PATENT DOCUMENTS

| | | | | |
|---|---|---|---|---|
| 3,717,977 A | | 2/1973 | Stone | 55/110 |
| 3,771,286 A | | 11/1973 | Scott | 15/277 X |
| 4,000,995 A | | 1/1977 | Morris | 55/512 X |
| 4,070,162 A | | 1/1978 | Kober et al. | 55/DIG. 25 |
| 4,222,748 A | | 9/1980 | Argo et al. | 55/6 |
| 4,304,096 A | | 12/1981 | Liu et al. | 60/274 |
| 4,319,891 A | | 3/1982 | Anderson et al. | 55/DIG. 25 |
| 4,338,784 A | | 7/1982 | Liu et al. | 60/274 |
| 4,355,504 A | | 10/1982 | Liu et al. | 60/275 |
| 4,478,613 A | | 10/1984 | Brettschneider et al. | 60/311 X |
| 4,569,682 A | | 2/1986 | Baker, Jr. et al. | 210/733 X |
| 4,625,872 A | | 12/1986 | DeLacy et al. | 209/557 |
| 4,649,703 A | | 3/1987 | Dettling et al. | 60/275 |
| 4,666,046 A | | 5/1987 | Manzer | 209/599 |
| 4,693,809 A | | 9/1987 | Bartholic et al. | 422/144 X |
| 4,702,075 A | | 10/1987 | Jenny | 60/274 |
| 4,734,105 A | | 3/1988 | Eliasson et al. | 55/338 X |
| 4,735,707 A | | 4/1988 | Bustamante | 209/5 |
| 4,765,803 A | * | 8/1988 | Hirth | 95/80 |
| 4,798,049 A | | 1/1989 | Mayer | 60/276 |
| 4,846,856 A | | 7/1989 | Burger et al. | 55/106 |
| 4,853,007 A | | 8/1989 | Leonhard et al. | 60/311 X |
| 4,858,431 A | | 8/1989 | Leonhard et al. | 60/297 |
| 4,864,821 A | | 9/1989 | Hoch | 60/274 |
| 4,880,444 A | | 11/1989 | Savins et al. | 210/701 X |
| 4,901,959 A | | 2/1990 | Stage | 248/97 |
| 4,945,721 A | | 8/1990 | Cornwell et al. | 60/274 |
| 4,956,152 A | | 9/1990 | Keough et al. | 422/181 |
| 4,962,643 A | | 10/1990 | Panten et al. | 60/288 |
| 4,972,957 A | | 11/1990 | Liu et al. | 209/143 |
| 4,976,749 A | | 12/1990 | Adamski et al. | 55/524 X |
| 4,980,030 A | | 12/1990 | Johnson et al. | 203/4 |
| 4,989,408 A | | 2/1991 | Leonhard et al. | 60/303 |
| 4,999,998 A | | 3/1991 | Akerib | 60/274 |
| 5,035,364 A | | 7/1991 | Escallon | 241/5 |
| 5,119,630 A | | 6/1992 | Matijas | 60/274 |
| 5,199,257 A | | 4/1993 | Colletta et al. | 60/275 |

(List continued on next page.)

*Primary Examiner*—Richard L. Chiesa
(74) *Attorney, Agent, or Firm*—Lathrop & Gage LC

(57) ABSTRACT

A size preferential electrostatic agglomerator is provided for agglomerating small particles with larger "carrier" particles. The agglomerator includes an inlet for receiving a gas flow, a separator for separating the gas flow into flow streams based on the size of the particles therein, an ionization region for imparting an opposite electrical charge to each of the flow streams, an agglomeration region receiving the flow streams to facilitate the agglomeration of the oppositely charged particles, and an outlet for exhausting the gas flow containing agglomerated particles to facilitate collection, processing or other activity on the agglomerated particles. The present invention provides an efficient system for gathering large amounts of small particles in a gas flow.

32 Claims, 5 Drawing Sheets

U.S. PATENT DOCUMENTS 5,215,557 A * 6/1993 Johnson et al. ..... 96/52
5,224,973 A 7/1993 Hoppenstedt et al. .. 55/DIG. 30
5,229,097 A 7/1993 Roeder et al. ..... 423/341
5,284,123 A 2/1994 Dones ..... 123/559.2
5,308,590 A 5/1994 Kersey et al. ..... 95/58 X
5,332,562 A 7/1994 Kersey et al. ..... 96/27 X
5,425,802 A * 6/1995 Burton et al. ..... 95/32
5,439,513 A 8/1995 Periasamy et al. ..... 96/25
5,458,850 A 10/1995 Krutzsch et al. ..... 422/21
5,478,531 A 12/1995 Yoshikawa ..... 422/177
5,579,107 A 11/1996 Wright et al. ..... 356/336
5,667,563 A 9/1997 Silva, Jr. ..... 96/50
5,695,549 A 12/1997 Feldman et al. ..... 96/55
5,707,428 A 1/1998 Feldman et al. ..... 96/54
5,733,360 A 3/1998 Feldman et al. ..... 95/78
5,779,764 A 7/1998 Gillen et al. ..... 95/79
5,824,137 A 10/1998 Gutsch et al. ..... 95/57
5,827,407 A 10/1998 Wang et al. ..... 204/164
5,843,210 A 12/1998 Paranjpe et al. ..... 95/59
5,849,250 A 12/1998 Timko ..... 422/177
5,849,251 A 12/1998 Timko ..... 422/177
5,885,330 A * 3/1999 Lee ..... 95/69
5,888,276 A 3/1999 Price et al. ..... 96/17
5,941,066 A 8/1999 Araki et al. ..... 60/280
5,972,215 A 10/1999 Kammel ..... 96/55 X
5,979,507 A 11/1999 Kojima et al. ..... 138/39
6,004,375 A 12/1999 Gutsch et al. ..... 95/57
6,089,211 A 7/2000 Wenger ..... 123/559.2
6,126,722 A 10/2000 Mitchell et al. ..... 95/57
6,224,652 B1 5/2001 Caperan et al. ..... 95/29
6,238,459 B1 5/2001 Downs ..... 95/64
6,245,126 B1 6/2001 Feldman et al. ..... 95/59
6,245,132 B1 6/2001 Feldman et al. ..... 96/28
6,257,869 B1 7/2001 Martin et al. ..... 431/7
6,282,371 B1 8/2001 Martin et al. ..... 392/490
6,302,944 B1 10/2001 Hoenig ..... 96/16
6,304,815 B1 10/2001 Moraal et al. ..... 701/115

* cited by examiner

METHOD AND APPARATUS FOR AGGLOMERATION

BACKGROUND OF THE INVENTION

1. Field of the Invention

This invention relates generally to the agglomeration of particles and, more particularly, to an agglomerator that separates particles by size into two groups and electrostatically induces an opposite charge to each of these groups to facilitate the agglomeration of the smaller particles to the larger particles.

2. Description of the Related Art

A variety of systems are known for collecting, detecting and/or filtering of particulate matter in flow streams of gases, liquids, and porous solids. These systems are used in a variety of ways: to clean air in an enclosed environment, to filter impurities from flow of combustible liquid, to detect the presence of certain particles, to collect particles from an exhaust flow for recombustion, as well as other uses. With respect to the collection of particles, inertial-based collection is regarded as the only viable technique in some systems, especially those requiring a low pressure drop, in-line separation, or collection into a liquid matrix for subsequent analysis, while still collecting relatively small particles, including submicron particles. For example, real-time or near real-time biological warfare detection systems most often require collected particles to be contained in a liquid sample. However, known inertial-based liquid collection systems, as well as electrostatic precipitators, while relatively efficient at collecting large particles (greater than about 2 micrometers, or 2 microns) have a poor collection efficiency for smaller particles, especially sub-micron particles. Thus, in many applications, no reliable solution exists for collecting such small particles.

The use of agglomerators is known for grouping small particles together to make such particles easier to collect. Unfortunately, this process is inefficient when small particles are grouped together with other small particles as they take a substantial amount of time to agglomerate to a sufficient size. Further, even if a significant number of small particles agglomerate, they may still be insufficiently sized in a certain dimension, making collection difficult.

To improve such agglomeration, it has been proposed to use bipolar charging on small and large size particles by giving each size group an opposite polarity. However, the prior art fails to teach a system for reliably separating a gas flow into streams of different sized particulate matter, imparting opposite electrical charges on the streams, and subsequently reintroducing the streams together downstream of the charging region to facilitate agglomeration of small particles to the large particles.

A device for agglomeration of particles in a gaseous flow is proposed in U.S. Pat. No. 6,224,652 of Caperan et al. A gaseous flow containing particulate matter is introduced into an inlet and an electrical charge of a given polarity is applied. The flow is then joined by a feedback loop of particles of a larger aerodynamic diameter having a charge of an opposite polarity and proceeds to the agglomeration chamber. An extraction unit acts as a separator to remove a gaseous flow containing larger particles for the feedback loop and send a gaseous flow containing small particles to the outlet of the device. The introduction of the feedback loop is said to further enhance the agglomeration process as smaller particles in the inlet flow are exposed to an increased concentration of larger particles.

Despite the benefits provided by the Caperan et al. device, it suffers from distinct disadvantages. Because larger particles are intentionally recirculated in the system with no mechanism for their removal, buildup of agglomerated particles occurs. While buildup of larger agglomerates will improve the agglomeration efficiency, it will also eventually obstruct flow in the system. Furthermore, because of the lack of a way to remove the agglomerated particles, sampling and analysis of the attached small particles is difficult and recirculation of the agglomerated particles will cause contamination in the system.

Another system for separating and removing particles from a gas or fluid stream is disclosed in U.S. Pat. No. 5,972,215, of Kammel. The system uses a precleaner, an agglomerator, a high-efficiency particle separator, a medium-efficiency particle separator, and a final particle separator to progressively clean the fluid stream of unwanted particles. Electrically charged augers may be provided in the precleaner to coagulate small particles on the surface of the augers. Once the coagulated particles reach a certain size, they are cast back into the flow stream for further separation. The agglomerator is formed of a wire mesh divided into positively and negatively charged packs. This configuration is said to enhance the diffusion and interception modes of particle collection. Additionally, the high-efficiency particle separator is equipped with louvers each having an opposite polarity to form an electrostatic field to enhance collection performance. However, Kammel requires a complicated series of filtering and separating devices and does not provide a system for enhanced preferential agglomeration of small particles onto larger "carrier" particles for increased collection efficiency. Thus, the agglomeration in Kammel only modestly increases the size of the particles of interest.

Thus, what is needed is a particle agglomerator for a gas or fluid flow stream that facilitates the agglomeration of a number of small particles onto larger "carrier" particles through electrostatic attraction to provide for better collection of the particles, analysis of the flow stream, and formation of agglomerated particles of a sufficient size to be reintroduced for more complete combustion. The agglomerated particles would include both solid particulate matter, liquid droplets, and small organisms. The device should be configured to accept a flow stream of both small and large particles or a flow stream of only small particles into which larger particles can be later introduced.

SUMMARY OF THE INVENTION

It is an object of the present invention to provide an agglomerator with electrostatic characteristics for the agglomeration of small particles onto larger "carrier" particles. It is a further object of the present invention to provide such a device configured to separate a flow stream into two flow streams, one containing small particles and the second containing larger particles, for imparting opposite electrical charges on each of the flow streams to aid in the electrostatic attraction of the particles for agglomeration. It is yet a further object of the invention to provide such a device that collects the agglomerated particles for further analysis or processing. It is still a further object of the present invention to provide such a device that exhausts out the flow stream with a minimal amount of particles present. It is also an object of the present invention to provide multiple agglomerators in series to further improve the efficiency of agglomeration. It is yet another object of the present invention to provide such a device that is simple to use, efficient in operation, and achieves sufficient agglomeration of small particles while only having a minimum amount of moving parts.

The present invention provides a size preferential electrostatic agglomerator that separates particle into different flow streams for imparting opposite electrical charges on each stream to maximize the agglomeration and collection of the small particles with larger "carrier" particles. The device comprises an inlet for receiving a flow of a gas into a chamber, a separator positioned in the chamber for separating the gas flow into first and second gas flow streams, the separator having a primary pathway in which the first gas flow stream comprised primarily of smaller particles is directed and a secondary pathway in which the second gas flow stream comprised primarily of larger particles is directed, an ionization region positioned in the chamber and downstream of the separator for receiving the gas flow, the ionization region having a first charging area within the primary pathway to impart an electrical charge on the smaller particles and a second charging area within the secondary pathway to impart an opposite electrical charge on the larger particles, an agglomeration region positioned in the chamber and downstream of the ionization region configured to receive the first and second gas flow streams and facilitate the agglomeration of smaller particles with the larger particles, and an outlet for exhausting the flow of gas out of the chamber. The larger particles can be of the type typically present in the gas flow or can be "seed" particles added to the flow.

In another aspect, a secondary separator can be added downstream of the agglomeration region of the present invention to separate the agglomerated particles from the major gas flow exhausted through the outlet to facilitate analysis or processing of the agglomerated particles. Whether or not the secondary separator is utilized, an inertial based sampler can be coupled to the present invention to receive the agglomerated particles. Additionally, multiple agglomerators can be placed in series to progressively agglomerate more of the smaller particles to the larger particles and improve collection efficiency.

In yet another aspect, the ionization region can be positioned in only one of either the primary or secondary pathway if the particles in the opposite pathway are already provided with a polarization. Thus, the particles travelling through the pathway having the ionization region would be imparted with an electrical charge opposite of the charge held by the particles travelling through the pathway without an ionization region.

Thus, the present invention provides improved collection efficiencies for relatively small particles by facilitating the larger particles becoming oppositely charged "carrier" particles for electrostatic attraction. In this way, the agglomeration of a larger amount of the small particles on the larger particles aids in collecting, detecting, and performing other functions on the small particles.

Other advantages and components of the present invention will become apparent from the following description taken in conjunction with the accompanying drawings, which constitute a part of this specification and wherein are set forth exemplary embodiments of the present invention to illustrate various objects and features thereof.

DETAILED DESCRIPTION OF THE INVENTION

Figure 1:
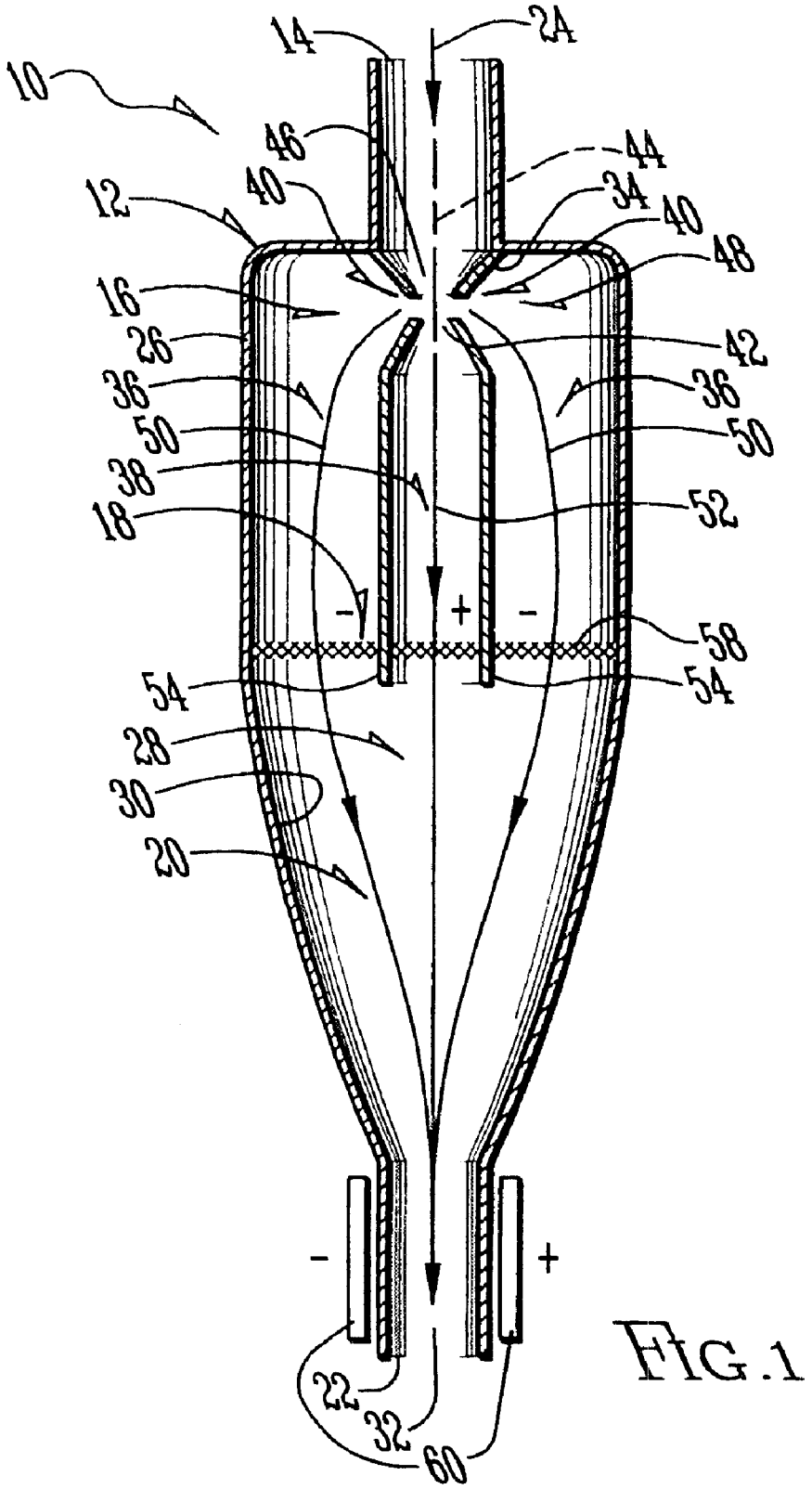
FIG. 1 is a cross-sectional view showing an embodiment of the agglomerator of the present invention in which the primary and secondary pathways of the separator are adjacent to one another.

A size preferential electrostatic agglomerator 10 in accordance with the present invention is shown generally at 10 in FIGS. 1–4. The agglomerator 10 comprises a chamber 12, an inlet 14 to the chamber, a separator 16, an ionization region 18, an agglomeration region 20 positioned within the chamber, and an outlet 22 from the chamber. Preferably, an air mover (not shown) is also provided to introduce a gas flow 24 containing particles into the chamber inlet 14, move the gas stream through the chamber 12, and exhaust the gas stream out of the outlet 22. The term particles, as used with the present invention, includes solid particulate matter, liquid droplets, and organic matter of a relatively small size such as microorganisms. The present invention finds many uses, including the detection of small particles in a gas flow, such as chemical or biological agents, the removal of particulate matter from an air stream, the coagulation of smaller organisms together, the collection of particles for more thorough combustion, among other uses.

The chamber 12 is generally a hollow housing forming a shell 26 that defines an inner region 28. A variety of materials may be used to construct the chamber 12 so long as an inner surface 30 of the chamber is electrically insulated, grounded, or supplied with the proper polarization as to not significantly attract agglomerated particles 32. Also, the chamber inner surface 30 is essentially chemically unreactive to any number of gas flows that are introduced within the chamber. The inlet 14 extends to the inner region 28 of the chamber 12 to deliver the gas flow 24 into the chamber. Ideally, the inlet 14 has a generally tubular shape to minimize turbulent flow, but can be of any number of hollow geometric configurations. In an alternative embodiment, the inlet 14 is merely a bore formed in the shell 26 of the chamber 12.

For enhanced particle separation, a nozzle 34, as shown in FIG. 1, is provided downstream of the inlet 14 to accelerate the gas flow 24 towards the separator 16. Upon passing through the nozzle 34, the gas flow 24 encounters a primary pathway 36 and secondary pathway 38 of the separator 16. An entrance 40 of the primary pathway 36 is positioned immediately upstream of an entrance 42 of a secondary pathway 38 and is configured to be at an angle to a longitudinal axis 40 of the nozzle 30. Contrastingly, the secondary pathway entrance 42 is configured to be in-line with the longitudinal axis 44 of the nozzle 30, or the centerline of the gas flow 24. Preferably the nozzle outlet 46 and the primary and secondary pathway entrances 40, 42 are circular in shape. This arrangement of the nozzle 34 and primary and secondary pathway entrances 40, 42 of the separator 16 forms a virtual impactor 48.

In operation of the virtual impactor 48, as the gas flow 24 attempts to continue to travel in a unidirectional path into the secondary pathway entrance 42, a void is formed because the primary pathway entrance 40 is encountered by the gas flow 24 before the secondary pathway entrance is reached. Because larger particles in the gas flow 24 will have a greater momentum than smaller particles, such larger particles will continue generally in the same direction, impact and move through the void into the secondary pathway entrance 42. The smaller particles will be directed, along with a significant volume of the gas flow 24, into the primary pathway entrance 40. In this way, the nozzle 34 and separator 16 of the present invention divide the gas flow 24 into a first gas flow stream 50 comprised substantially of smaller particles and a second gas flow stream 52 comprised substantially of larger particles. The efficiency of the virtual impactor 48 in segregating the smaller and larger particles into their respective flow streams is related to a number of factors, including the ratio of the secondary pathway entrance 42 diameter to the nozzle outlet 46 diameter, the shape of the secondary pathway entrance 42, the alignment of the longitudinal axis 40 of the nozzle 30 with the secondary pathway entrance 42, and the shape of the nozzle outlet 46 and the first and second pathway entrances 40, 42, among other factors. Preferably, the primary and secondary pathway entrances 40, 42 are configured such that about 85–95 percent of the gas flow volume travels into the primary pathway 32 as the first gas flow stream 50. This gas flow volume distribution is best realized when the secondary pathway entrance 42 has a diameter that is about 30–40 percent larger than the diameter of the nozzle outlet 46.

Although one embodiment of a virtual impactor 48 has been described herein, it is to be understood that other configurations of virtual impactors known in the art can be used in the present invention to separate a main flow stream into large particle and small particle flow streams. Further, as an alternative to using the virtual impactor 48 described herein, other inertial based separators such as cyclonic and centrifugal separators can be implemented to divide the gas flow 24 into the first gas flow stream 50 and second gas flow stream 52 described above.

The classification of particles as that being of a smaller size or a larger size will depend how the present invention is configured for a specific application. For example, various particle collectors or processors receive agglomerated particles of at least a particular size depending on the accuracy of the collector, the efficiency of collection, and other factors. Preferably, the agglomerator 10 of the present invention is configured such that the smaller particles that make up a substantial portion of the first gas flow stream 50 have a diameter that is equal to or less than about 2 micrometers, or 2 microns. Therefore, the larger particles that makes up a substantial portion of the second gas flow stream 52 has a diameter that is greater than about 2 microns. It is also to be understood that the larger particles can be that present in the gas flow 24 prior to entering the chamber 12, or can be seed particles added to the flow 24 prior to the agglomeration region 20. These seed particles are preferably selected for their ability to be easily separated with the virtual impactor 48 and quickly ionized in the ionization region 18 to act as a carrier particles for agglomeration with smaller particles. The seed particles should also have a large dielectric constant and be sized to provide maximum collection. If such seed particles are in a liquid form, they also provide the benefit of not adding any solid particulate matter to the system, thereby enhancing ease of collection and sampling of the agglomerated particles 32.

In the embodiment shown in FIG. 1, the pathway walls 54 of the secondary pathway 38 are configured to be flat, planar members that extend the interior height of the chamber 12 to section the primary pathway 36 into two distinct paths each having an entrance 40 positioned laterally on opposite sides of the secondary pathway entrance 42. Each primary pathway 36 extends longitudinally through the chamber 12 adjacent and parallel to the secondary pathway 38, the pathways 36, 38 merge downstream of the ionization region 18. Alternatively, the walls 54 form a tubular structure such that a single primary pathway 36 circumscribes the secondary pathway 38. Immediately downstream of the pathway entrances 40, 42, the primary and secondary pathways 36, 38 preferably have a region of increased cross-sectional dimension to dethrottle the first and second gas flow streams 50, 52. This arrangement reduces the flow velocity to ensure that the flow streams spend sufficient time in the ionization region 18 to enable the particles disposed therein to become ionized before the primary and secondary pathways 36, 38 merge downstream.

Figure 2:
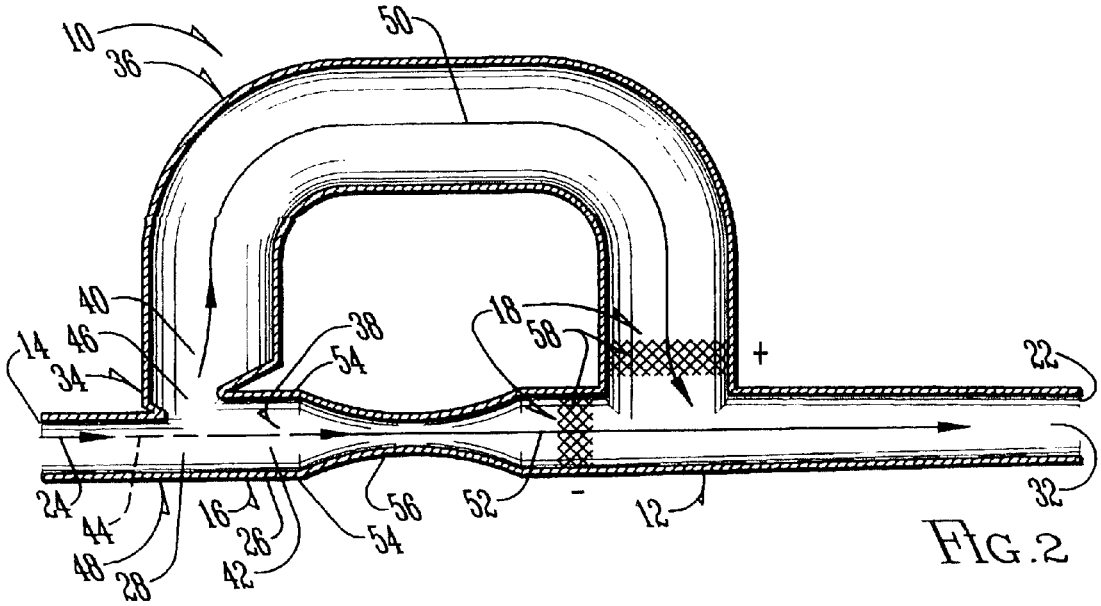
FIG. 2 is a cross-sectional view showing an embodiment of the agglomerator of the present invention in which the secondary pathway of the separator forms a loop that is spaced away from the primary pathway.

As will be understood by those skilled in the art, separator 16 can take the form of another embodiment as depicted in FIG. 2. In this configuration, the primary pathway 36 extends away from the secondary pathway 38 near the secondary pathway entrance 42 and forms a generally U-shaped passage to recombine with secondary pathway 38 downstream of the ionization region 18. When the first gas flow stream 50 of the primary pathway 36 meets the second gas flow stream 52 of the secondary pathway 38, the streams generally have velocity vectors orthogonal to one another to promote mixing of the ionized small and large particles for agglomeration. To provide the correct ratio of flows between stream 50 and stream 38, a flow constriction 56 is placed in the pathway 38. The flow constriction 56 forms a narrowing and then broadening cross-sectional area of the pathway 38 in the direction of flow. Such an arrangement further accentuates the void in the secondary pathway entrance 42 that forces the smaller particles into the primary pathway 36.

Travelling towards the downstream end of the primary and secondary pathways 36, 38, the first and second gas flow streams 50, 52, respectively, encounter an ionization region 18. The ionization region 18 has a charging apparatus 58 that spans the width and height of the pathways 36, 38 and imparts opposite electrical charges on the particles in the first and second gas flow streams 50, 52 that pass through the apparatus. For example, the charging apparatus 58 can be configured to introduce a negative electrical charge to the smaller particles of the first gas flow stream 50 and a positive charge to the larger particles of the second gas flow stream 52, or vice versa. The electrostatic attraction between the oppositely charged particles facilitates efficient agglomeration. The charging apparatus 58 is a high voltage wire screen as shown in FIGS. 1 and 2. Alternatively, if it is desired to increase the charge density of the particles for better agglomeration, an elongate metal honeycomb having a greater surface area for charging the particles, or a corona discharge, is provided. It should also be noted that the chamber inner surface 30 preferably is provided with a like charge to the ionized smaller particles such that these particles do not adhere to the chamber and proceed to be agglomerated.

In another embodiment, the ionization region 18 can be positioned in only one of either the primary or secondary pathways 36, 38 if the particles in the opposite pathway are already provided with a polarization. For example, some microscopic bioaerosols are naturally negatively charged and therefor charging for such particulate matter in a flow stream may not be required. In this instance, positive charging of the larger particles of the second gas flow stream 52 may provide for sufficient agglomeration without the need for charging of the already negatively charged bioaerosols in the ionization region 18.

The length of the primary and secondary pathways 36, 38 downstream of the ionization region is determined based on two factors. First, such length should be fairly abrupt to ensure that the charged particles of the first and second flow streams 50, 52 do not have time to lose their charge and return to a state of electrical neutrality before entering the agglomeration region 20. Second, the length must be sufficient to ensure that particles do not try and exit one pathway and reenter another, and that adjacent charging apparatus 58 do not contaminate each other through electrical discharge.

The primary and secondary pathways 36, 38 recombine to reform the original gas flow 24, but with ionized particles, in the agglomeration region 20. As the flow proceeds, the smaller and larger particles having an opposite polarity are electrostatically attracted to one another and begin to agglomerate. Because the surface area of each large particle is much greater than any small particle, more than one, and sometime a significant number, of smaller particles agglomerate onto the surface of one larger particle. This action significantly speeds up the agglomeration process as small particles quickly find a larger "carrier" particle. The net result is the formation of larger and more easily collected agglomerates with a concurrent reduction of the number of smaller unagglomerated particles.

The cross-sectional dimension of the chamber 12 preferably diminishes in the agglomeration region 20 as the gas flow 24 travels downstream to constrict the flow and thereby force the ionized smaller and larger particles to agglomerate. Further, this flow constriction increases the velocity of gas flow 24 to carry the agglomerated particles 32 out of the agglomeration region 20 towards the outlet 22. The length of the agglomeration region 20 in the chamber 12 should be sufficient to agglomerate a substantial amount of the particles, and will depend on the flow rate of the gas flow 24, the ability of the particles to be ionized, and the geometry of the chamber 12 in the agglomeration region 20, among other factors. Agglomeration can be further encouraged by placing an electromagnetic field generator 60, preferably an electromagnetic coil or electrostatic discharge apparatus operating near the agglomeration region 20 or outlet 22 of the chamber 12, as shown in FIG. 1. The electromagnetic field generator 60 produces an electromagnetic field at switchable frequency or frequencies to cause ionized particles to move laterally in the chamber 12 in addition to longitudinally in the direction of flow. Thus, further agglomeration of oppositely charged smaller and larger particles is facilitated.

The primary and secondary pathways 36, 38 can be further configured to improve the mixing of the smaller and larger particles of the first and second flow streams 50, 52, respectively, as they enter the agglomeration region 20. For example, either or both of the downstream ends of the pathways 36, 38 can be formed with injectors and configured such that the flow streams 50, 52 encounter each other at an angle, as shown in FIG. 2, to facilitate mixing through the impingment of one flow stream against another. The injectors can take the form of an jet, nozzle, tube or other orifice.

Depending on the flow of the first and second flow streams 50, 52 and the configuration with which they encounter each other, the use of static mixers can be used in the agglomeration region 20 to enhance radial or lateral mixing in laminar flow. A helical mixer is optimal in these types of flow conditions and splits the recombined gas flow 24 into semi-circular channels that twist as they flow through the mixer. Alternatively, when turbulent flow is created by the recombination of the first and second flow streams 50, 52 in the gas flow 24, vortex generating devices are ideally implemented in the agglomeration region 20. Turbulent vortex mixers have a series of tab arrays separated longitudinally by the diameter of the chamber 12 in the agglomeration region 20 to enhance mixing of the larger and smaller particles for agglomeration. Minimal energy consumption is achieved in these mixers by optimizing the tab geometry, including the shape, length, width, and angle of attack of the tabs.

The outlet 22 extends from the agglomeration region 20 to deliver the gas flow 24 and agglomerated particles 32 contained therein outside the chamber 12 for collection, processing, or other activity. Also, the outlet 22 can have a tapering cross-sectional area, no taper, or an expanding cross-sectional area in the direction of flow depending on what is to be done with the agglomerated gas flow 24 once it leaves the chamber 12.

Figure 5:
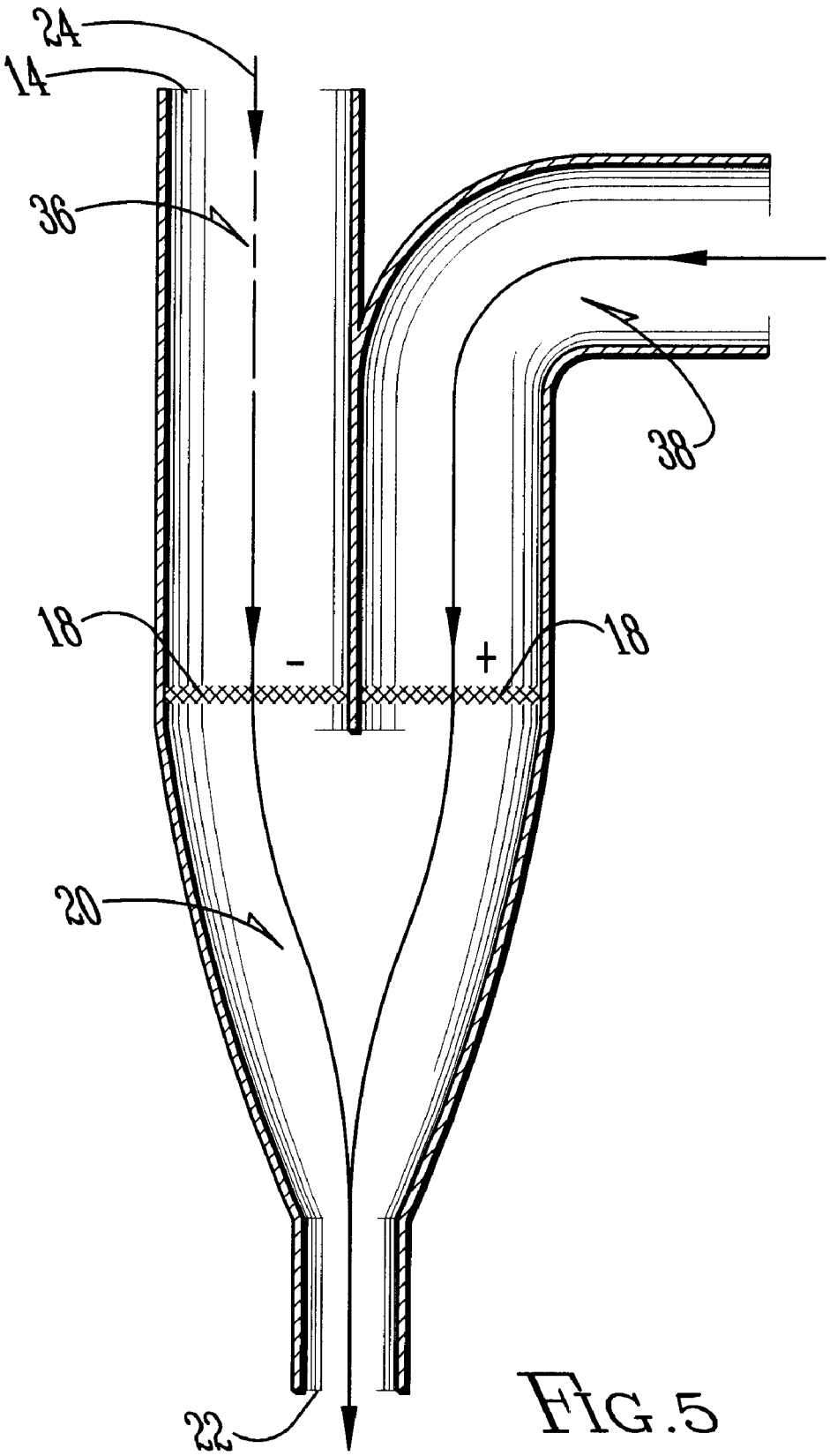
FIG. 5 is a cross-sectional view showing an embodiment of the agglomerator of the present invention in which the main gas flow travels only into the primary pathway prior to agglomeration.

In an alternative embodiment to that shown in FIGS. 1 and 2, the separator 16 is removed from the present invention and the gas flow 24 is directed from the inlet 14 into only a single primary pathway 36, as shown in FIG. 5. This will typically be done if there are insufficient large particles in the gas flow 24 to facilitate adequate agglomeration of the smaller particles present in the gas flow, or if such agglomeration needs to be enhanced. Larger "seed" particles are introduced into a flow in the secondary pathway 38 with an entrance separate from the inlet 14 and not receiving any of the gas flow 24. These larger particles have an electrical charge opposite of that of the particles present in the primary pathway 36, and can be ionized either prior to introduction into the secondary pathway 38 or in the optional ionization region 18 of the secondary pathway. The larger "seed" particles and smaller particles are then agglomerated in the agglomeration region 20 as described herein for the embodiments of FIGS. 1 and 2.

Figure 3:
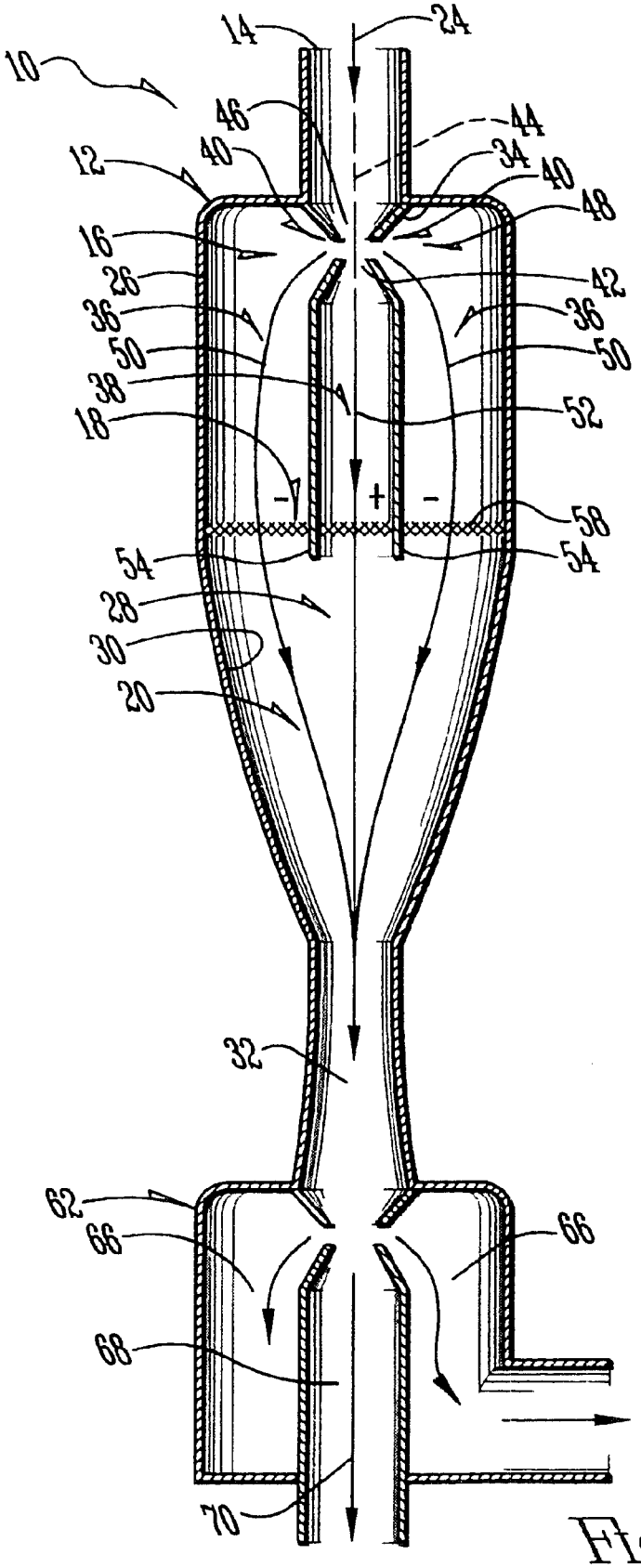
FIG. 3 is a cross-sectional view showing an embodiment of the agglomerator of the present invention as in FIG. 1 with the addition of a secondary separator positioned downstream from the agglomeration region in which the primary and secondary pathways of the secondary separator are adjacent to one another.
Figure 4:
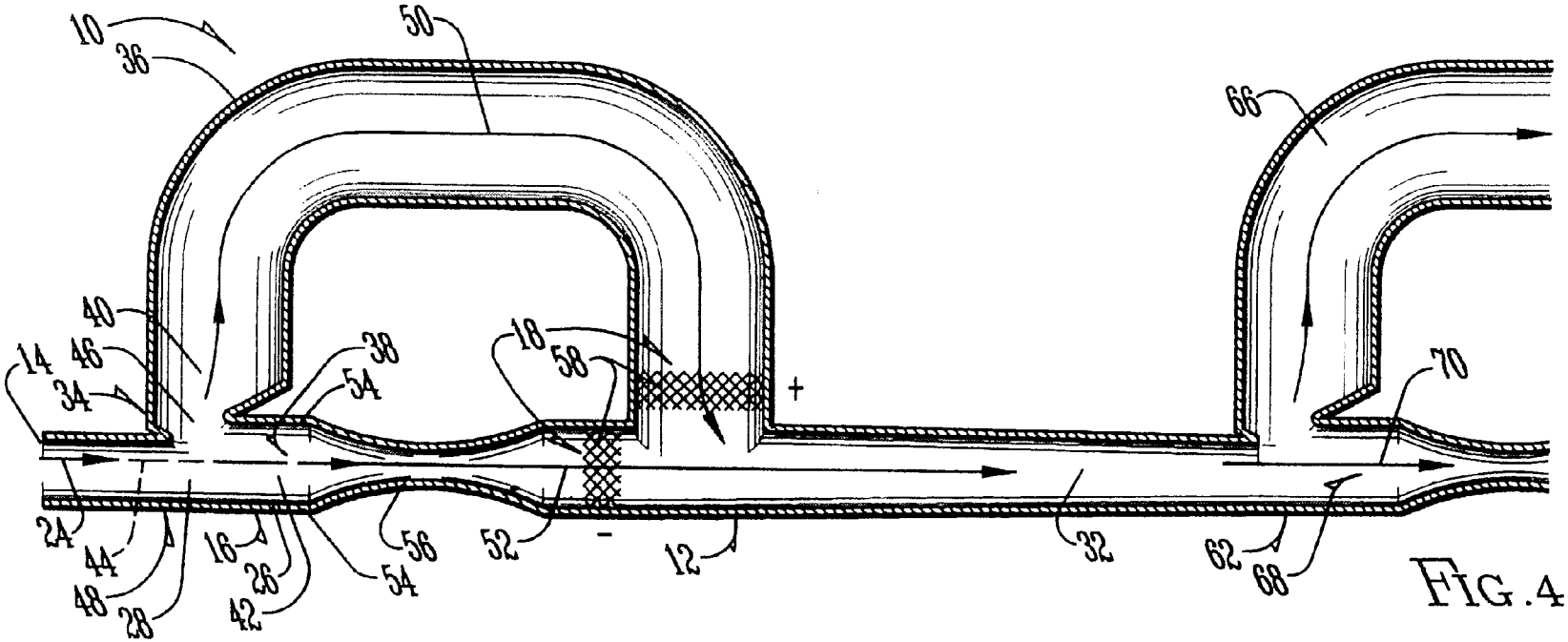
FIG. 4 is a cross-sectional view showing an embodiment of the agglomerator of the present invention as in FIG. 2 with the addition of a secondary separator positioned downstream from the agglomeration region in which the secondary pathway of the separator forms a loop that is spaced away from the primary pathway.

In the embodiment shown in FIGS. 3 and 4, a second separator 62 is connected to the outlet 22 for receiving the agglomerated gas flow 24 and performing further particle separation. The second separator 62 allows the agglomerated particles 32 to be separated from a significant volume of the gas flow 24 to aid in the collection process. For example, the separated agglomerated particles 32 can be filtered by a filtering mechanism to remove the particles from the gas flow 24, such as air, and return the cleaner air to the environment, or gathered by an inertial-based sampler to detect the presence or concentration of the smaller particles in the gas flow 24. In another method of usage, particles originally collected from a combustion system exhaust and sent through the agglomerator 10 of the present invention form agglomerated particles 32 that can be sent to an afterburner in a combustion system to further combust the particles.

The entrance of the second separator 62 is preferably configured to be same virtual impactor 48 as described herein for the first separator 16. Alternatively, the separator 62 can take the form of another separation means such as a cyclonic or centrifugal separator. In the configurations of FIGS. 3 and 4, the primary pathway 66 of the second separator 62 receives a first gas flow stream 68 having a relatively low concentration of smaller particles and a high percentage of the gas flow volume, and exhausts the stream outside of the chamber 12. The first gas flow stream 68 contains such a low amount of particles because these smaller particles have been previously agglomerated with the larger particles. Likewise, the secondary pathway 68 of the second separator 62 receives a second gas flow stream 70 having a relatively high concentration of agglomerated particles 32 and a low percentage of the gas flow volume. By segregating the agglomerated particles 32 from most of the gas flow volume, the size and power consumption of the collector can be reduced and the collection efficiency increased because less effort is needed to "pull" the particles out of the gas flow.

Depending on the necessity of agglomerating a very high percentage of the small particles, it is to be understood that the present invention can be configured with multiple agglomerators 10 in series. In this way, the agglomerators of FIGS. 3 and 4 are further provided with additional ionization regions 18 and agglomeration regions 20 downstream of the primary and secondary pathways 66, 68 to progressively agglomerate more of the smaller particles to the larger particles and previously agglomerated particles 32. This process results in more complete collection of the smaller particles and provides an exiting gas flow 24 that has a further reduced level of contaminants. For example, combustion pollutants can be agglomerated over multiple cycles to further reduce the amount of particulate matter in the exhaust flow resulting in cleaner air exhausted into the environment Thus, the size preferential electrostatic agglomerator of the present invention provides a fast and efficient way to agglomerate smaller particles that is normally difficult to collect onto larger particles. This apparatus utilizes a separator to divide a gas flow into one having smaller particles dispersed therein and another having larger particles dispersed therein, and provides each flow with an opposite electrical charge. When the flows are reintroduced together, the electrostatic attraction between oppositely charged large and small particles facilitates their agglomeration. It is also to be understood that the chamber 12 of the present invention can be a single container partitioned into the separation and agglomeration sections, or can be a series of containers connected by closed passageways to transport the gas flow through the entire system. Furthermore, the present invention can be used for agglomeration of charged organisms. While certain forms of the present invention have been illustrated and described herein, it is not to be limited to the specific forms or arrangement of parts described and shown.

What is claimed is:

1. An apparatus for selectively separating contaminants in a gas, the apparatus comprising:

an inlet for receiving a flow of the gas into a chamber;

a separator positioned within the chamber for separating the gas into first and second flow streams, the separator having a primary pathway in which the first flow stream comprised primarily of particles of a first size is directed and a secondary pathway in which the second flow stream comprised primarily of particles of a second size is directed, the particles of a second size being larger than the particles of the first size;

an ionization region positioned within the chamber and downstream of the separator to receive the gas flow, the ionization region having a charging area located within at least one of the primary pathway and secondary pathway to impart an electrical charge on the particles of the respective flow streams travelling therein;

an agglomeration region positioned within the chamber and downstream of the ionization region, the agglomeration region configured to receive the first flow stream of the primary pathway and the second flow stream of the secondary pathway and coagulate the particles of the first size with particles of the second size to form agglomerated particles; and an outlet for exhausting the flow of gas out of the chamber.

2. The apparatus of claim 1 wherein the charging area of the ionization region forms a first charging area located within the primary pathway to impart an electrical charge on the particles of the first flow stream and a second charging area located within the secondary pathway to impart an electrical charge on the particles of the second flow stream, the electrical charge of the second flow stream being opposite the electrical charge of the particles of the first flow stream.

3. The apparatus of claim 2, wherein the first and second charging areas of the ionization region are each formed with an electrically charged screen.

4. The apparatus of claim 3, wherein the electrically charged screen of the first and second charging areas is an elongate metal honeycomb.

5. The apparatus of claim 2, wherein the first and second charging areas of the ionization region are each formed with a corona discharge.

6. The apparatus of claim 2, wherein the particles of the first size of the first flow stream have a diameter that is less than about 2 microns and the particles of the second size of the second gas flow stream have a diameter that is greater than about 2 microns.

7. The apparatus of claim 2, wherein the separator is operably configured such that the first flow stream comprises at least 80 percent of the volume of the gas flow into the chamber.

8. The apparatus of claim 2, wherein the separator is configured such that the first flow stream comprises approximately 85 to 95 percent of the volume of the gas flow into the chamber.

9. The apparatus of claim 2, wherein a nozzle is positioned within the chamber between the inlet and the separator and is configured to receive the gas flow from the inlet and accelerate the gas flow into the separator to facilitate flow of the second flow stream into the secondary pathway.

10. The apparatus of claim 9, wherein the primary and secondary pathways each have a dethrottling region immediately downstream of the entrances of the primary and secondary pathways, the dethrottling region of the primary pathway having a greater cross-sectional area than the entrance of the primary pathway and the dethrottling region of the secondary pathway having a greater cross-sectional area than the entrance of the secondary pathway.

11. The apparatus of claim 9, wherein the secondary pathway has a flow control constriction positioned between the entrance of the secondary pathway and the second charging area of the ionization region and sized to create a void in the gas flow such that only particles of a desired size enters the second flow stream.

12. The apparatus of claim 11, wherein the flow control constriction has a first region having a narrowing cross-sectional area in the direction of the flow and a second region having an increasing cross-sectional area in the direction of the flow.

13. The apparatus of claim 2, wherein at least a portion of the agglomeration region comprises a throttle region having a narrowing cross-sectional area in the direction of the flow.

14. The apparatus of claim 2, further comprising a secondary separator positioned within the chamber and downstream of the agglomeration region for separating the gas flow having the agglomeration particles into first and second gas flow streams, the secondary separator having a exhaust pathway connected to the outlet in which the first gas flow stream comprised primarily of particles of a first size is directed and a processing pathway in which the second gas flow stream comprised primarily of particles of a second size that is larger than the first size is directed.

15. The apparatus of claim 14, wherein the processing pathway has a downstream end that is configured to be coupled to an afterburner.

16. The apparatus of claim 14, wherein the processing pathway has a downstream end that is configured to be coupled to a particle collector.

17. The apparatus of claim 2, further comprising an air mover to move the gas flow into the inlet of the chamber and out of the outlet of the chamber.

18. The apparatus of claim 2, wherein at least a portion of an inner wall of the chamber in the agglomeration region is provided with an electrical charge that is the same as the electrical charge imparted on the particles of the first size to prevent such particles from collecting on the at least a portion of the chamber inner wall.

19. The apparatus of claim 2, further comprising an electromagnetic field generator to create an electromagnetic field in a portion of the chamber downstream of the ionization region to enhance the agglomeration of particles of the first size with particles of the second size.

20. The apparatus of claim 2, wherein the separator is a cyclonic separator.

21. The apparatus of claim 2, wherein the separator is a centrifugal separator.

22. The apparatus of claim 2, wherein the first and second charging areas can be of selected and opposite polarity.

23. An apparatus for selectively separating contaminants in a gas, the apparatus comprising:

an inlet for receiving a flow of a gas into a chamber;

a virtual impactor positioned within the chamber for separating the gas flow into a first flow stream comprised primarily of particles of a first size and a second flow stream comprised primarily of particles of a second size that is larger than the first size, the virtual impactor comprising a nozzle configured to receive the gas flow from the inlet and accelerate the gas flow, at least one primary pathway entrance positioned at an angle with respect to the longitudinal axis of the nozzle for receiving the first flow stream, and a secondary pathway entrance positioned downstream of the at least one primary pathway and aligned with the longitudinal axis of the nozzle for receiving the second gas flow stream;

primary pathway extending from the primary pathway entrance;

secondary pathway extending from the secondary pathway entrance and positioned adjacent to the primary pathway;

an ionization means positioned within each of the primary pathway and the secondary pathway and configured to impart an electrical charge of a given polarity on the particles of the first gas flow stream and impart an electrical charge of an opposite polarity on the particles of the second gas flow stream;

an agglomeration region positioned within the chamber and downstream of the ionization region, the agglomeration region extending from a downstream end of each of the primary pathway and the secondary pathway and configured to receive the first flow stream of the primary pathway and the second flow stream of the secondary pathway and facilitate the agglomeration of particles of the first size with particles of the second size; and an outlet for exhausting the flow of gas out of the chamber.

24. The apparatus of claim 23, wherein the particles of the first size have a diameter that is less than about 2 microns and the particles of the second size have a diameter that is greater than about 2 microns.

25. The apparatus of claim 23, wherein the first and second charging areas can be of selected and opposite polarity.

26. A method for agglomerating particles of differing sizes, the method comprising the steps of:

introducing a gaseous flow having particles dispersed therein into a chamber;

separating the gaseous flow into a first gas flow stream comprised primarily of particles of a first size and a second gas flow stream comprised primarily of particles of a second size that is larger than the first size;

ionizing the first and second gas flow streams by imparting an electrical charge on the particles of the first gas flow stream and imparting an electrical charge on the particles of the second gas flow stream that is opposite of that of the particles of the first gas flow stream;

recombining the first and second gas flow streams and agglomerating the particles of the first size with particles of the second size; and exhausting the gaseous flow out of the chamber.

27. The method of claim 26, wherein the particles of the first size have a diameter that is less than about 2 microns and the particles of the second size have a diameter that is greater than about 2 microns.

28. The method of claim 26, wherein the step of separating the gaseous flow into a first gas flow stream comprised primarily of particles of a first size and a second gas flow stream comprised primarily of particles of a second size that is larger than the first size comprises accelerating the gaseous flow towards an opening in a secondary pathway within the chamber to force the second gas flow into the secondary pathway while allowing the first gas flow stream to travel into a primary pathway.

29. The method of claim 26, further comprising the step of collecting a portion of the agglomerated particles to detect for the presence of the particles of the first size.

30. The method of claim 26, further comprising the step of separating the agglomerated particles from at least a portion of the gaseous flow.

31. The method of claim 30, further comprising the step of analyzing the agglomerated particles.

32. The method of claim 30, further comprising the step of combusting the agglomerated particles.

* * * * *